US008323064B2

(12) United States Patent
Lessing

(10) Patent No.: US 8,323,064 B2
(45) Date of Patent: Dec. 4, 2012

(54) BODY BOARD AND REINFORCING ELEMENT

(75) Inventor: Christiaan Stefanus Lessing, Altona (AU)

(73) Assignee: PJ Whit Pty Ltd, Williamstown, VIC (AU)

( * ) Notice: Subject to any disclaimer, the term of this patent is extended or adjusted under 35 U.S.C. 154(b) by 203 days.

(21) Appl. No.: 12/940,076

(22) Filed: Nov. 5, 2010

(65) Prior Publication Data

US 2011/0045721 A1 Feb. 24, 2011

(30) Foreign Application Priority Data

Apr. 7, 2010 (AU) ..... 2010901458

(51) Int. Cl.
*B63B 1/00* (2006.01)

(52) U.S. Cl. ..... 441/65; 441/74

(58) Field of Classification Search ..... 441/65, 441/74

See application file for complete search history.

(56) References Cited

U.S. PATENT DOCUMENTS 3,414,919 A 12/1968 Gust
4,276,844 A * 7/1981 Fremont ..... 114/39.14
4,919,632 A * 4/1990 Smith et al. ..... 441/44
5,711,692 A * 1/1998 Pope ..... 441/74
6,036,560 A 3/2000 Pekar
7,347,754 B1 * 3/2008 Cheung ..... 441/65
7,938,705 B2 * 5/2011 Fitzgerald ..... 441/74
2007/0017427 A1 * 1/2007 Rytand ..... 114/263

FOREIGN PATENT DOCUMENTS

FR 2496044 A1 6/1982
WO WO2009158349 A1 12/2009

OTHER PUBLICATIONS

Australian Patent Office, International Search Report, Jan. 21, 2011, PCT/AU2010/001454, Woden Act , Australia.

Chris Belyea, "Response to Examiner's report" in the ISR, Feb. 10, 2011, Elsternwick, Australia.

B. Vafa, "Examiner'S First Report on Innovation Patent No. 2010101202 by PJ WHIT PTY LTD," Jan. 4, 2011, Australian Government, IP Australia, Woden Act, Australia.

* cited by examiner

*Primary Examiner* — Stephen Avila

(74) *Attorney, Agent, or Firm* — Louis Ventre, Jr.

(57) ABSTRACT

A body board (1) is provided having a cavity (2) into which reinforcing elements (4) may be interchangeably inserted through an opening (3) by the user to vary the flexing characteristics of the board. The reinforcing elements may be provided with securing parts adapted to engage with a retainer in the board to securely hold the reinforcing element in place.

9 Claims, 9 Drawing Sheets

BODY BOARD AND REINFORCING ELEMENT

CROSS-REFERENCE TO RELATED APPLICATIONS

This application claims the benefit of Australian provisional application 2010901458, filed on 7 Apr. 2010, which is hereby incorporated by reference herein.

TECHNICAL FIELD

The present invention relates to body boards for recreational purposes, and elements for providing reinforcement of them.

BACKGROUND ART

Body boards are a popular recreational and sporting product typically used for riding waves. They are usually constructed out of a dense foam outer shell surrounding a foam type core. It is common practice to also manufacture a reinforcing element called a "stringer" into the interior of the body board, to prevent excessive flexing and potential buckling of the board in the surf. Such reinforcing elements can be cylindrical rods made of fiberglasses other suitable material and are inserted during manufacture into a cavity drilled or molded into the core.

Once manufactured, the rigidity properties of the board are fixed, but it may be perceived as advantageous to the skilled body boarder to be able to adjust the rigidity of the body board to suit different surf conditions.

There is therefore a need to provide a way of allowing the amount of reinforcement or rigidity of the body board to be adjusted after manufacture.

SUMMARY OF INVENTION

According to a broad aspect of the invention there is provided a body board comprising a cavity for holding a reinforcing element, adapted to allow removal and replacement of the reinforcing element by a user.

In one embodiment, the body board cavity comprises a sleeve to facilitate insertion and removal of the reinforcing element.

In one embodiment, a retainer on the body board is adapted to engage with a securing part on the reinforcing element. The retainer and securing part may engage via corresponding screw threads. The retainer may be attached to the sleeve near an outer end thereof. The securing part of the reinforcing element may be attached to an outer end thereof.

In one embodiment, the body board is combined with at least one of the reinforcing elements.

In a second broad aspect of the invention there is provided a reinforcing element adapted to be removably inserted into a cavity of a body board by a user.

In one embodiment, the reinforcing element comprises a securing part adapted to engage with a retainer on the body board. The securing part may engage with the retainer on the body board via corresponding screw threads. The securing part may be attached to an outer end of the reinforcing element. The reinforcing element may further comprise a seal to engage with the body board to prevent ingress of water into the cavity.

In a third broad aspect of the invention there is provided a set of reinforcing elements of the second broad aspect, having a range of rigidities and adapted to be interchangeably used with the body board.

DESCRIPTION OF EMBODIMENTS

Embodiments of the current invention will now be described with reference to the Figures.

Figure 1:
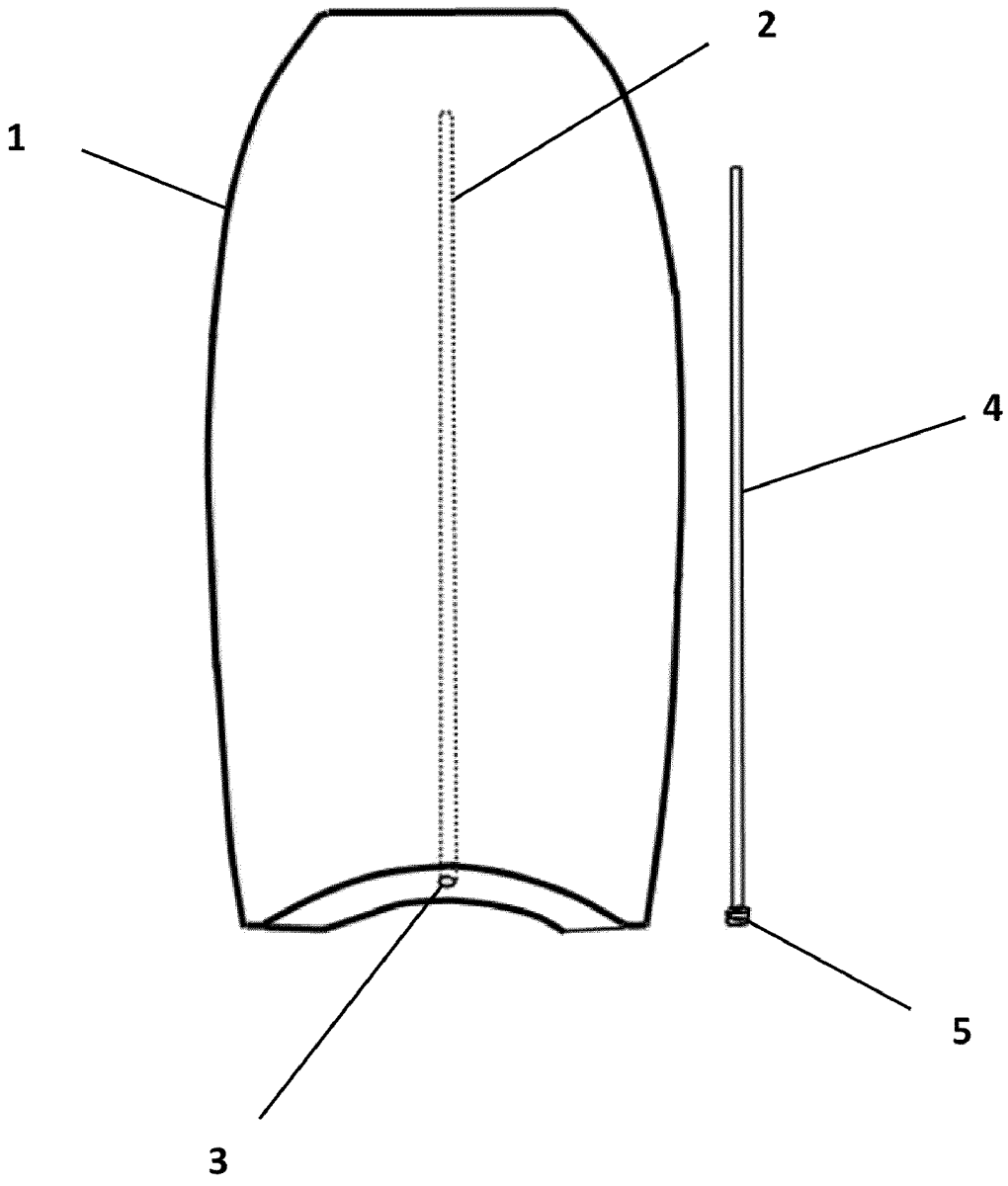
FIG. 1 shows a body board and reinforcing element in accordance with one embodiment of the invention.

Referring first to FIG. 1, body board 1 composed of an outer shell and inner foam core comprises a cavity 2. Cavity 2 extends through the shell at an end 3 thereof to provide insertion access. End 3 also comprises a retainer. A reinforcing element 4 comprises a cylindrical rod made of fiberglass, carbon fiber or similar material as is known in the art. Attached to an outer end of reinforcing element 4 is a securing part adapted to engage with the retainer.

Figure 2:
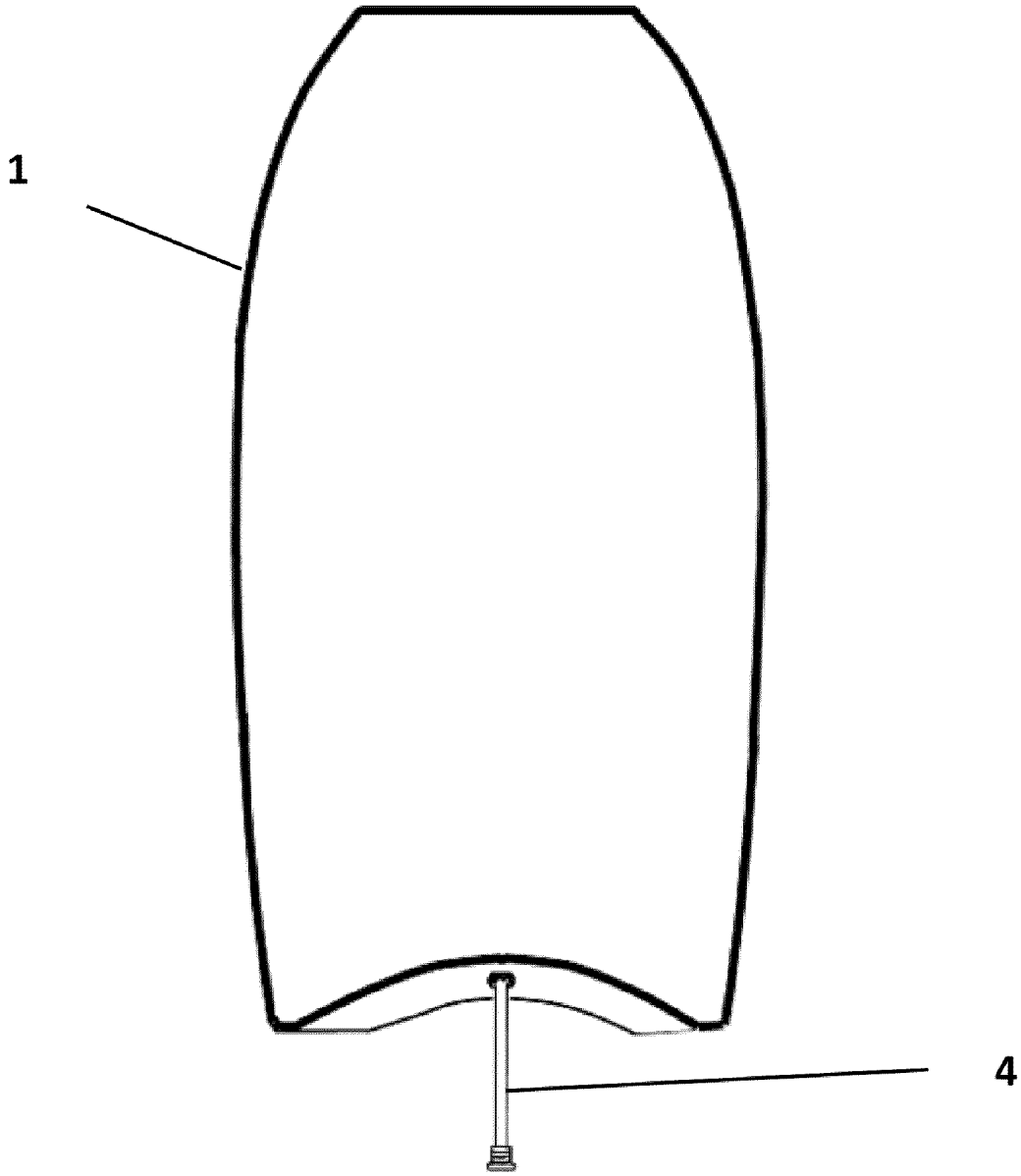
FIG. 2 shows the body board and reinforcing element of the embodiment of FIG. 1 with the reinforcing element part way inserted into the cavity.

Referring now to FIG. 2, reinforcing element 4 is shown inserted part way into the cavity.

Figure 3A:
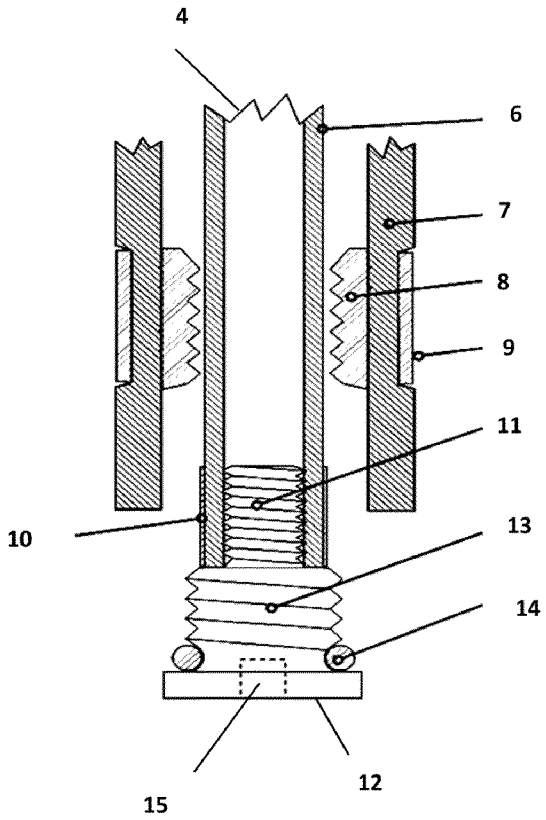
FIGS. 3A and 3B shows details of a retainer on the body board and the securing part on the reinforcing element in the embodiment of FIG. 1.

Referring now to FIG. 3A, details of the reinforcing element and cavity are shown. Reinforcing element 4 comprises a cylindrical fiberglass rod 6 adapted to slide inside sleeve 7 which lines the cavity, and a metal outer sleeve 10 at an outer end thereof. Sleeve 7 is composed of flexible plastic tubing glued to the foam core and is able to flex with the board at the same time as providing a durable and smooth surface to facilitate insertion and removal of reinforcing element 4. Near an outer end of the sleeve 7 is attached a retainer comprising stainless steel inner female screw thread 8 held in place by metal crimp clamp 9. Screwed into the fiberglass rod 6 with a male screw thread 11 is a stainless steel securing part 12 having a larger male screw thread 13 adapted to engage with the female screw thread 8 of the retainer. Securing part 12 further comprises a seal 14 adapted to engage with the retainer so as to prevent ingress of water into the cavity, and a recessed slot 15 to allow tightening of the security part onto the retainer with an Allen key or other appropriate tool.

Figure 3B:
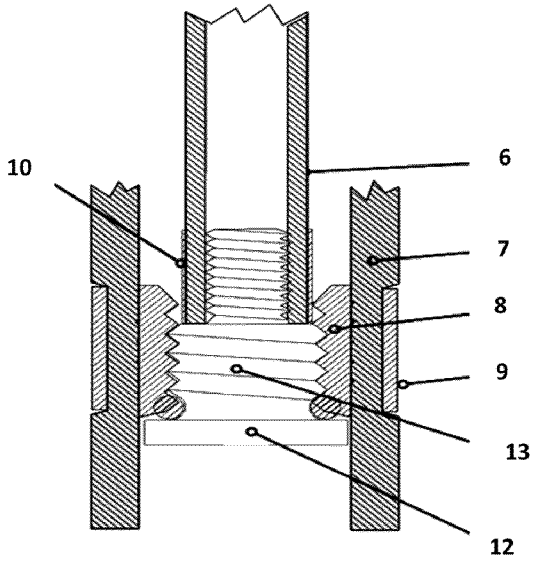

Referring now to FIG. 3B, the reinforcing element is shown in the secured position.

Figure 4:
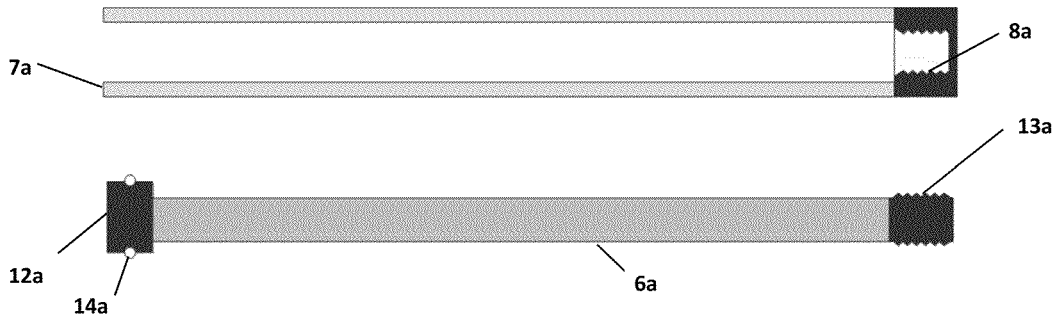
FIG. 4 shows an alternative to the configuration of FIGS. 3A and 3B.

Referring now to FIG. 4, an alternative configuration is shown to that of FIGS. 3A and 3B. In this embodiment, the male screw thread 13*a* is at the opposite end of the reinforcing element, and engages with a corresponding female screw thread 8*a* at the innermost end of the sleeve 7*a*.

Figure 5:
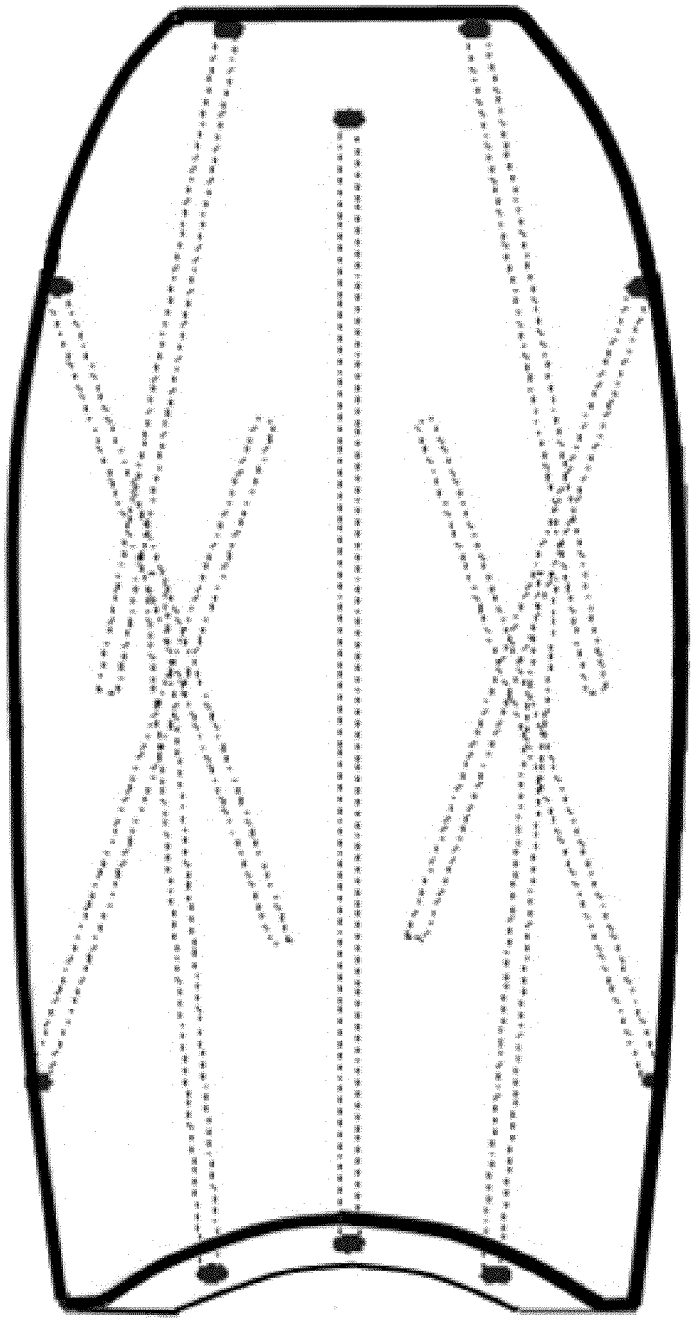
FIG. 5 shows a range of alternative cavity positions for embodiments of the invention.

Referring now to FIG. 5, there are shown examples of alternative orientations and positions of the cavity in different embodiments of the invention. Multiple cavities are also within the scope.

Figure 6:
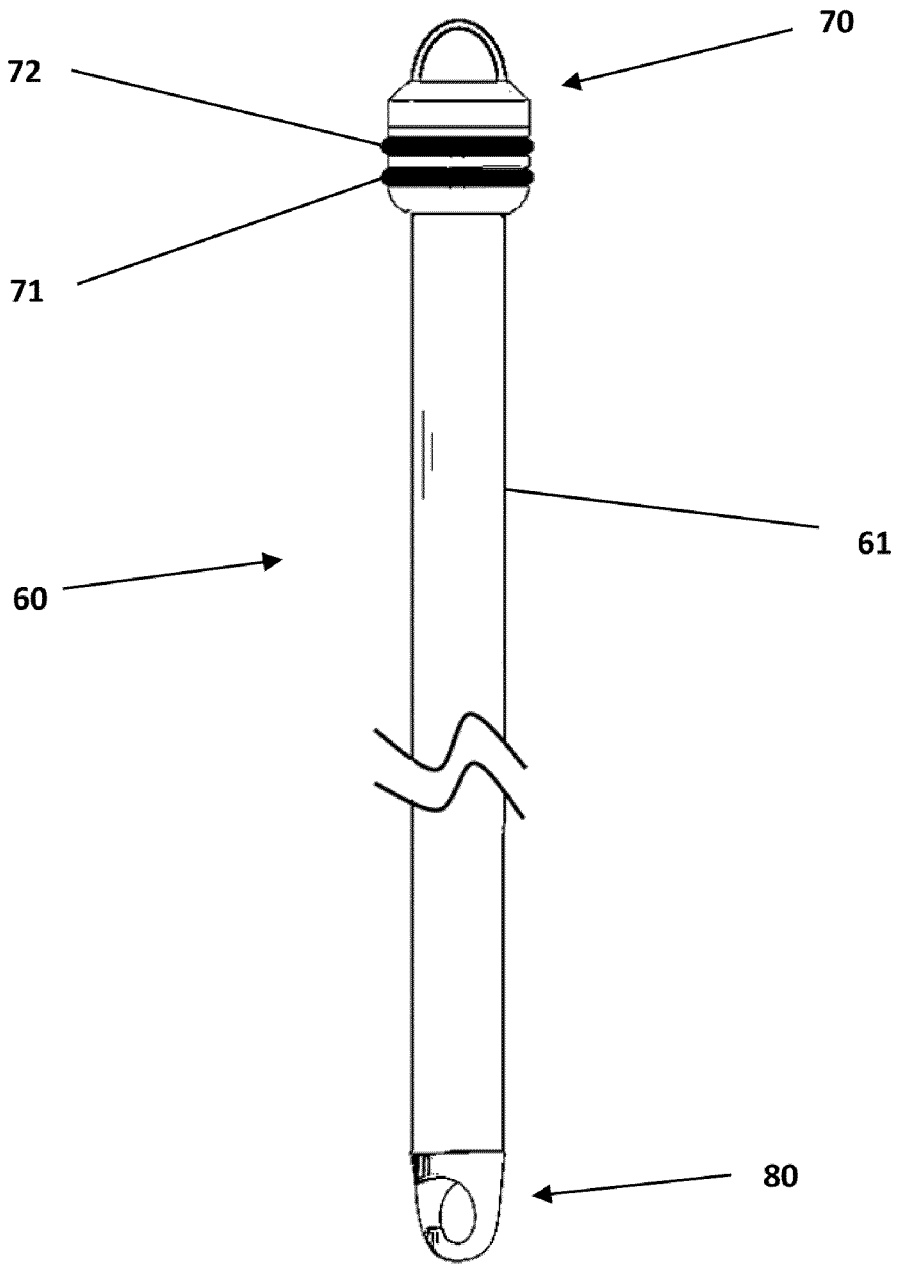
FIG. 6 shows an assembled reinforcing element according to the currently most preferred embodiment.
Figure 7:
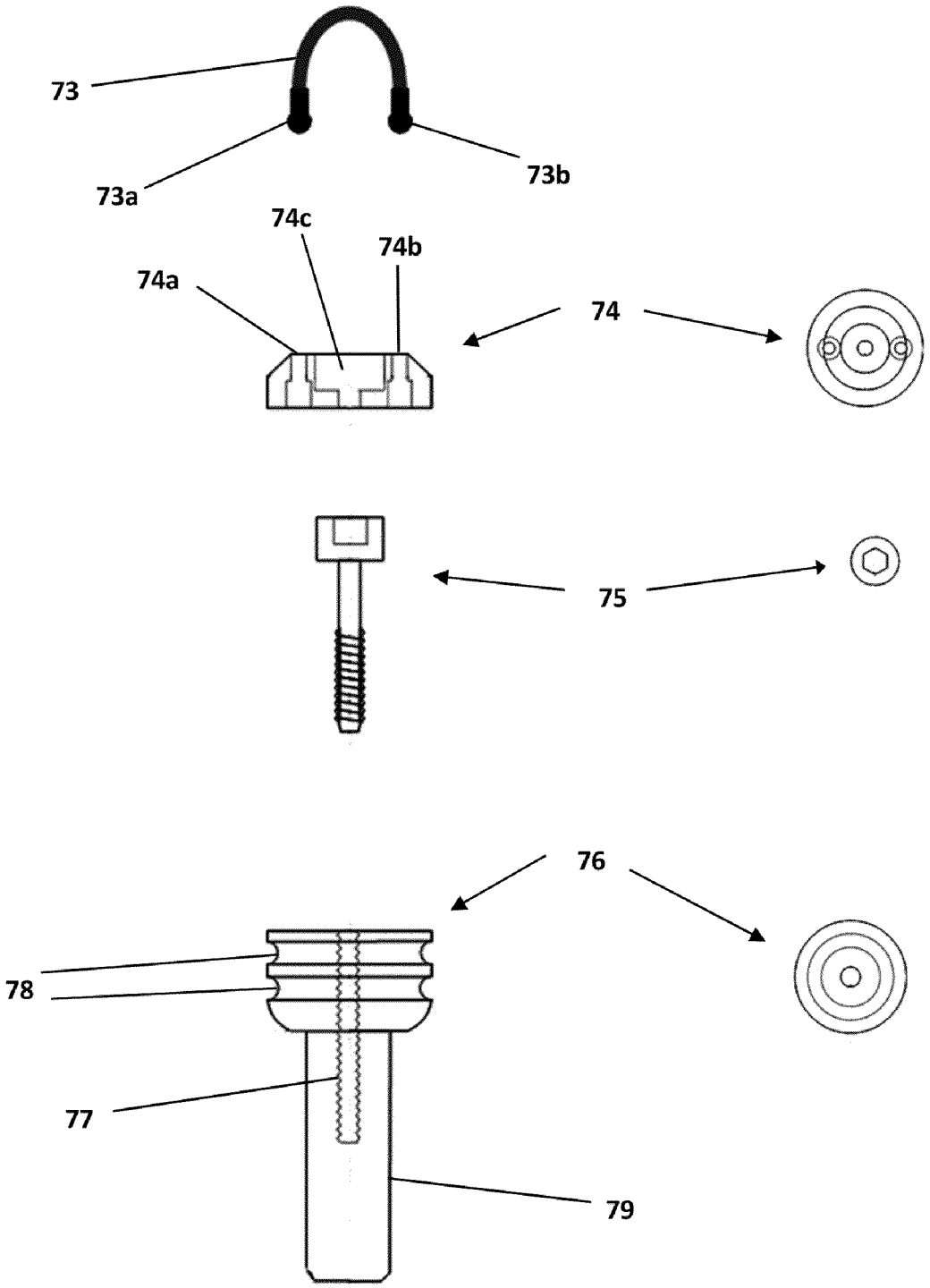
FIG. 7 shows details of a handle and seal of the reinforcing element of FIG. 6
Figure 8:
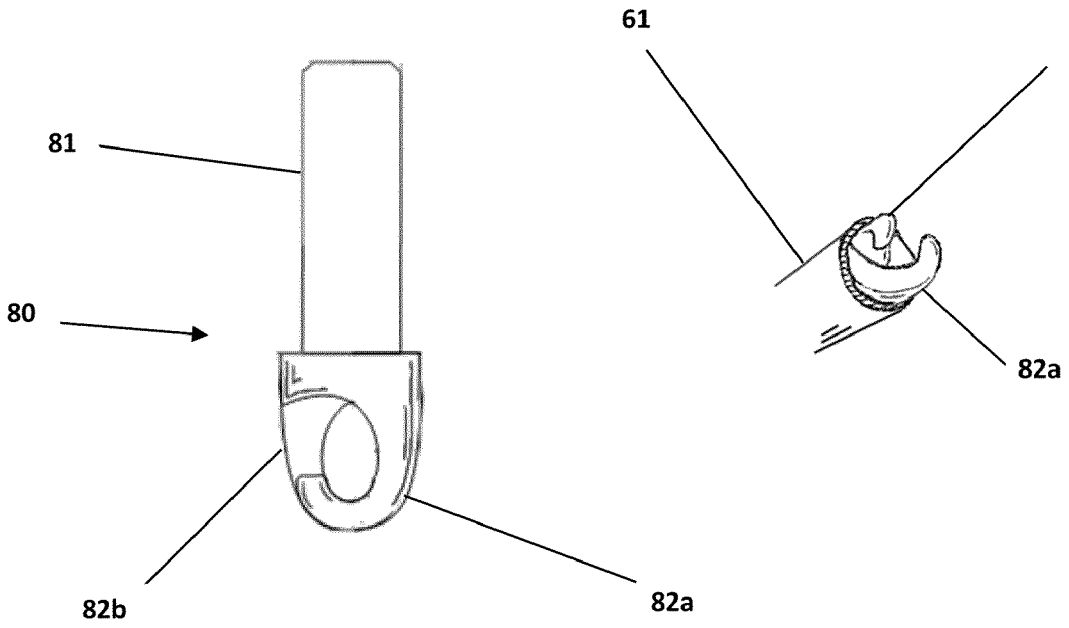
FIG. 8 shows details of the securing part of the reinforcing element of FIG. 6.
Figure 9:
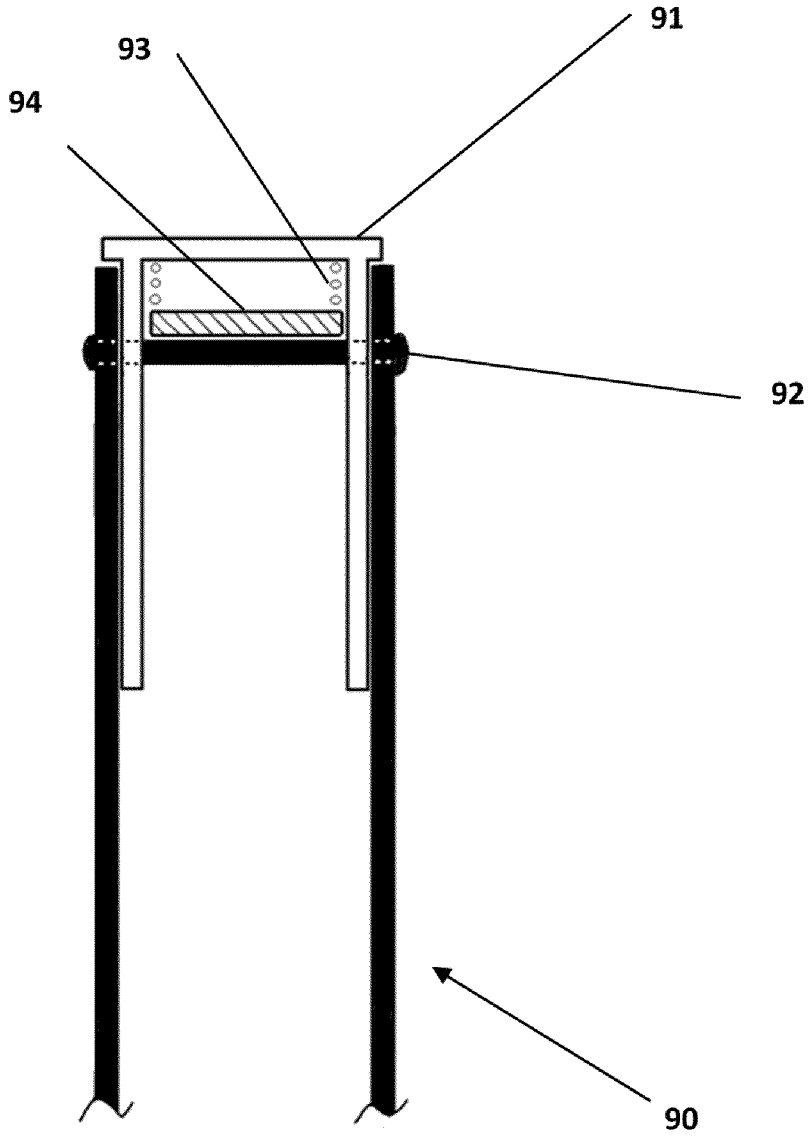
FIG. 9 shows details of the retainer in the body board adapted to receive the securing part of the reinforcing element of FIG. 6.

Referring now to FIG. 6, assembled reinforcing element 60 according to the currently most preferred embodiment of the invention comprises hollow reinforcing rod 61 with inner diameter 13 mm and outer diameter 16 mm, handle and seal assembly 70 with two O-ring seals 71 and 72, and securing part 80. Referring to FIG. 7, handle and seal assembly 70 comprises nylon coated stainless steel cable 73 with ends 73*a* and 73*b* that are crimped during manufacture after insertion through handle holes 74*a* and 74*b* in cap 74. The head of stainless steel bolt 75 rests inside recess 74*c* and passes the through the centre hole of the aluminum cap 74, and bolt 75 screws into thread 77 of aluminum rod engaging part 76. Rod engaging part 76 has circular cross section and comprises two O-ring seal channels 78 to receive O-rings 71 and 72, sized appropriately to engage with the inside of a 19 mm sleeve in the body board cavity, and a lower cylindrical section 79 sized to fit snugly inside the rod 61 at the outer end thereof, as viewed when installed in the body board. Referring to FIG. 8, aluminum securing part 80 has a rod engaging part 81 also sized to fit snugly inside the rod 61 at the inner end of rod 61, and hook-shaped spiral lock elements 82*a* and 82*b*. The spiral lock elements 82*a* and 82*b* engage with a retainer at an inner end of a sleeve lining the cavity in the board. Referring to FIG. 9, sleeve 90 is an ordinary 19 mm diameter polyethylene irrigation pipe lining the cavity. Sleeve 90 may be held in the cavity by heat fusion of the outer end thereof with a base of the body board. The retainer comprises polyethylene end plug 91 (also as normally supplied for irrigation pipes) into which has been installed an aluminum or stainless steel rivet 92 passing also through sleeve 90 fix the end cap and to provide an engaging bar for the spiral lock elements 82*a* and 82*b*. When the securing part of rod 61 is pushed up the sleeve and after engaging with bar provided by rivet 92, a quarter turn will cause spiral lock elements 82*a* and 82*b* to hook over the bar and be retained. Washer 94 spring-loaded with spring 93 urges the hooks to remain in the retained position. Removal involves the user pushing inwards on the handle and making a reverse quarter turn, whereby the reinforcing element can be pulled out.

There is thus provided a body board and removable reinforcing elements that together can provide an enhanced sporting experience. It will be appreciated that the invention comprises in its various aspects a board adapted to receive removable reinforcing elements, a combined board and reinforcing element, and the reinforcing element itself, alone or as part of a set having a range of flexibilities, adapted to be used interchangeably in a body board.

Persons skilled in the art will also appreciate that many variations may be made to the invention without departing from the scope of the invention.

For example, the retainer shown can be varied or may not be needed, and the reinforcing element may not necessarily require a securing part, depending on the design of the board. Further, the body of the reinforcing element can be made from any effective rigidity material or shape. Further still, the board may comprise more than one of the cavities for holding respective reinforcing elements.

These and other modifications may be made without departing from the scope of the invention, which is defined in the claims and summary.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

What is claimed is:

1. A system comprising a body board and a set of interchangeable stringers for installation therein, the body board comprising:

an outer shell defining in use an outer surface of the body board;

an inner foam core; and the inner foam core defining a cavity that starts from a hole in the outer shell at the outer surface, said cavity terminating within the inner foam core;

the set of interchangeable stringers comprising:

two or more stringers each sized and shaped to be installed interchangeably within the cavity by insertion through the hole and to be removable and replaceable through the hole by a user of the body board, each stringer in the set of interchangeable stringers having a different rigidity property; and whereby rigidity of the body board is adjusted depending upon which one of the stringers in the set of interchangeable stringers is installed within the cavity.

2. The system of claim 1, wherein a retainer on the body board engages with a securing part so as to secure the installed stringer within the cavity during use.

3. The system of claim 2, wherein the retainer and securing part engage via corresponding screw threads.

4. The system of claim 2, wherein the retainer is disposed near an outer end of the cavity.

5. The system of claim 1, further comprising a seal engaged by each stringer in the set of stringers against the body board to prevent ingress of water into the cavity.

6. The system of claim 2 wherein said securing part is a respective securing part attached to each stringer in the set of stringers.

7. The system of claim 6, wherein the securing part of each stringer in the set of stringers is attached to an outer end thereof.

8. The system of claim 6, wherein the cavity comprises a sleeve to facilitate insertion and removal of each stringer in the set of stringers and the retainer is attached to the sleeve near an inner end thereof.

9. The system of claim 8, wherein the securing part of each stringer in the set of stringers is attached to an inner end thereof.

* * * * *